US006711745B2

(12) United States Patent
Sullivano et al.

(10) Patent No.: US 6,711,745 B2
(45) Date of Patent: Mar. 30, 2004

(54) SLIP-ON BALL GLOVE

(75) Inventors: Brian A. Sullivano, St. Charles, IL (US); Shigeaki Aso, Arlington Heights, IL (US); Patrick Udelhofen, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 87 days.

(21) Appl. No.: 10/002,644

(22) Filed: Nov. 30, 2001

(65) Prior Publication Data

US 2003/0101501 A1 Jun. 5, 2003

(51) Int. Cl.[7] ..... A41D 13/08
(52) U.S. Cl. ..... 2/19; 2/161.1
(58) Field of Search ..... 2/19, 16, 20, 158, 2/159, 160, 161.1, 161.2, 161.5, 161.6, 162, 166, 167, 169; 473/205

(56) References Cited

U.S. PATENT DOCUMENTS

| | | | | | |
|---|---|---|---|---|---|
| 284,150 | A | * | 8/1883 | Whitaker | 2/162 |
| 323,263 | A | * | 7/1885 | Blomstrom | 2/169 |
| 402,287 | A | * | 4/1889 | Tyrrell | 2/167 |
| 1,519,913 | A | * | 12/1924 | Hynes | 2/158 |
| 3,119,118 | A | * | 1/1964 | Beebe | 2/162 |
| 3,430,265 | A | * | 3/1969 | Mazza | 2/162 |
| 3,606,614 | A | * | 9/1971 | Dimitroff | 2/159 |
| 3,721,996 | A | * | 3/1973 | Nadorf | 2/19 |
| 4,065,813 | A | | 1/1978 | Hudson | 2/19 |
| 4,651,345 | A | | 3/1987 | Latina | 2/19 |
| 4,853,975 | A | * | 8/1989 | Clevenhagen | 2/19 |
| 5,214,798 | A | | 6/1993 | McLaughlin | 2/160 |
| 5,367,707 | A | | 11/1994 | Murai | 2/19 |
| 5,406,649 | A | * | 4/1995 | Bolembach | 2/158 |
| 5,457,819 | A | | 10/1995 | Aoki | 2/19 |
| 5,498,234 | A | * | 3/1996 | Martel et al. | 602/64 |
| 5,575,005 | A | | 11/1996 | Walker et al. | 2/19 |
| 5,799,327 | A | | 9/1998 | Clevenhagen | 2/19 |

FOREIGN PATENT DOCUMENTS

| | | | | |
|---|---|---|---|---|
| JP | 7213675 | * | 8/1995 | A63B/71/14 |

* cited by examiner

*Primary Examiner*—Gary L. Welch
(74) *Attorney, Agent, or Firm*—Terence P. O'Brien

(57) ABSTRACT

A ball glove including front and back portions, at least one notch, and at least one elastic strip. The front and back portions have front and back lower edges, respectively. The back portion is coupled to the front portion to form a hand cavity. The front and back portions are separated along the front and back lower edges to define a hand-receiving opening. The notch is formed into the back portion and upwardly extends from the back lower edge. The at least one elastic strip extends across the notch generally parallel with the back lower edge. The strip at least partially fills the notch and is fixedly secured to the back portion. The at least one elastic strip enables the hand-receiving opening to resiliently expand to receive a user's hand and then to generally conform to the user's wrist.

27 Claims, 6 Drawing Sheets

SLIP-ON BALL GLOVE

FIELD OF THE INVENTION

The present invention relates generally to a ball glove for baseball, softball and other sports. In particular, the present invention relates to a ball glove having at least one resilient panel positioned at a hand-receiving opening of the ball glove for expendably receiving a user's hand and for generally conforming to the wrist of the user.

BACKGROUND OF THE INVENTION

Ball gloves for use in baseball, softball and other sports are well known. Ball gloves typically include a front panel connected to a corresponding back panel to form a hand cavity. The front and back panels typically generally resemble the shape of a human hand and when assembled form five stalls for receiving the thumb and fingers of a user's hand. A webbing is typically connected between the thumb stall and the index finger stall of the ball glove. Ball gloves also typically include a hand opening for enabling a user to insert his or her hand into the hand cavity of the ball glove. The size of the hand opening of ball gloves is often fixed.

Ball gloves with hand-openings of a fixed size have a drawback of often being loose on the user's wrist. As a result, such ball gloves are easily mis-positioned on the user's hand and are susceptible to falling off the user's hand, particularly young users. Many ball gloves include fastening mechanisms for tightening or reducing the size of the hand opening around the user's wrist after the user's hand is inserted into the glove. The fastening mechanisms typically take the form of at least one strap, which is secured to the glove at one end and is releasably secured to the glove at a second end with a releasable fastener. The releasable fasteners can include buttons, snap-fit connectors, buckles, or hook and loop type fasteners. Other ball gloves include two overlapping strap members connected to a dial operated adjusting mechanism for manually reducing or enlarging the size of the hand opening.

Although these fastening mechanisms can effectively close or tighten the hand opening about the user's wrist and subsequently release or enlarge the hand opening to allow the user to remove his or her hand from the glove, these mechanisms also have a number of drawbacks. These fastening mechanisms require manual operation to tighten or enlarge the hand opening to accommodate the user's hand during use. These manual actions must be repeatedly performed by the user during play and, especially, during ball games and practice sessions. Many of these fastening mechanisms, such as hook and loop type connectors, have a finite useful life that often is less than the useful life of the ball glove. Also, effective operation of these fastening mechanisms generally requires that the user possess a fair amount of dexterity, hand strength and motor skills. Not surprisingly, many younger users simply are unable to effectively manipulate such fastening mechanisms. As a result, it is not uncommon for a parent, a coach or another adult to assist a younger user with putting on, removing or adjusting the young user's glove. Moreover, these fastening mechanisms often require readjustment during use. This repeated manipulation and readjustment of the fastening mechanism can be considered a nuisance and a distraction to the user. Further, many of these fastening mechanisms are rather bulky and can provide the glove with an unattractive appearance.

Thus, there is a continuing need for a ball glove having a hand opening that readily expands and contracts to enable the user's hand to enter the hand cavity of the ball glove and to generally conform to the size of the user's wrist. What is needed is a ball glove that automatically adjusts to the size of the user's hand and wrist without requiring one or more separate, secondary manual adjustments. It would be advantageous to provide a ball glove that is easy to put on and take off, and that readily adapts to the size of the user's wrist thereby substantially eliminating or significantly reducing the need for subsequent adjustments of the glove. What is also needed is a ball glove that enables a younger user to put on and take-off without assistance. It would also be advantageous to provide a ball glove that provides these advantages and also provides the ball glove with an improved, more appealing aesthetic.

SUMMARY OF THE INVENTION

The present invention provides a ball glove for receiving a hand, and generally conforming to the wrist, of a user. The ball glove includes a front portion, a back portion, at least one notch, and at least one elastic strip. The front portion has a front lower edge. The back portion is coupled to the front portion to form a hand cavity. The back portion has a back lower edge, an inner surface and an outer surface. The front and back portions are separated along the front and back lower edges to define a hand opening. The notch is formed into the back portion from the back lower edge and extends through the inner and outer surfaces of the back portion. The elastic strip includes first and second ends. The strip extends across the notch generally parallel with the back lower edge. The strip at least partially covers the notch. The first and second ends of the strip are fixedly secured to the back portion. The at least one elastic strip enables the hand opening to resiliently expand to receive the hand of the user and then contract to generally conform to the wrist of the user.

According to a principal aspect of a preferred form of the invention, a ball glove for receiving a hand, and generally conforming to the wrist, of a user includes a front portion, a back portion, and at least one elastic panel. The front and back portions have front and back lower peripheral regions, respectively. The front lower peripheral region has first and second front connection portions spaced apart by a front hand-receiving portion. The back lower peripheral region has first and second back portions spaced apart by a back hand-receiving portion. The first and second front connection portions are connected to the first and second back connection portions, respectively. The front and back hand-receiving portions define a hand opening for removably receiving the hand of the user. The back hand-receiving portion includes at least one upwardly extending notch. The elastic panel is fixedly secured to the back hand-receiving portion at the notch and substantially covers the notch. The elastic panel has an exposed lower edge that is unattached to the back lower peripheral region.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
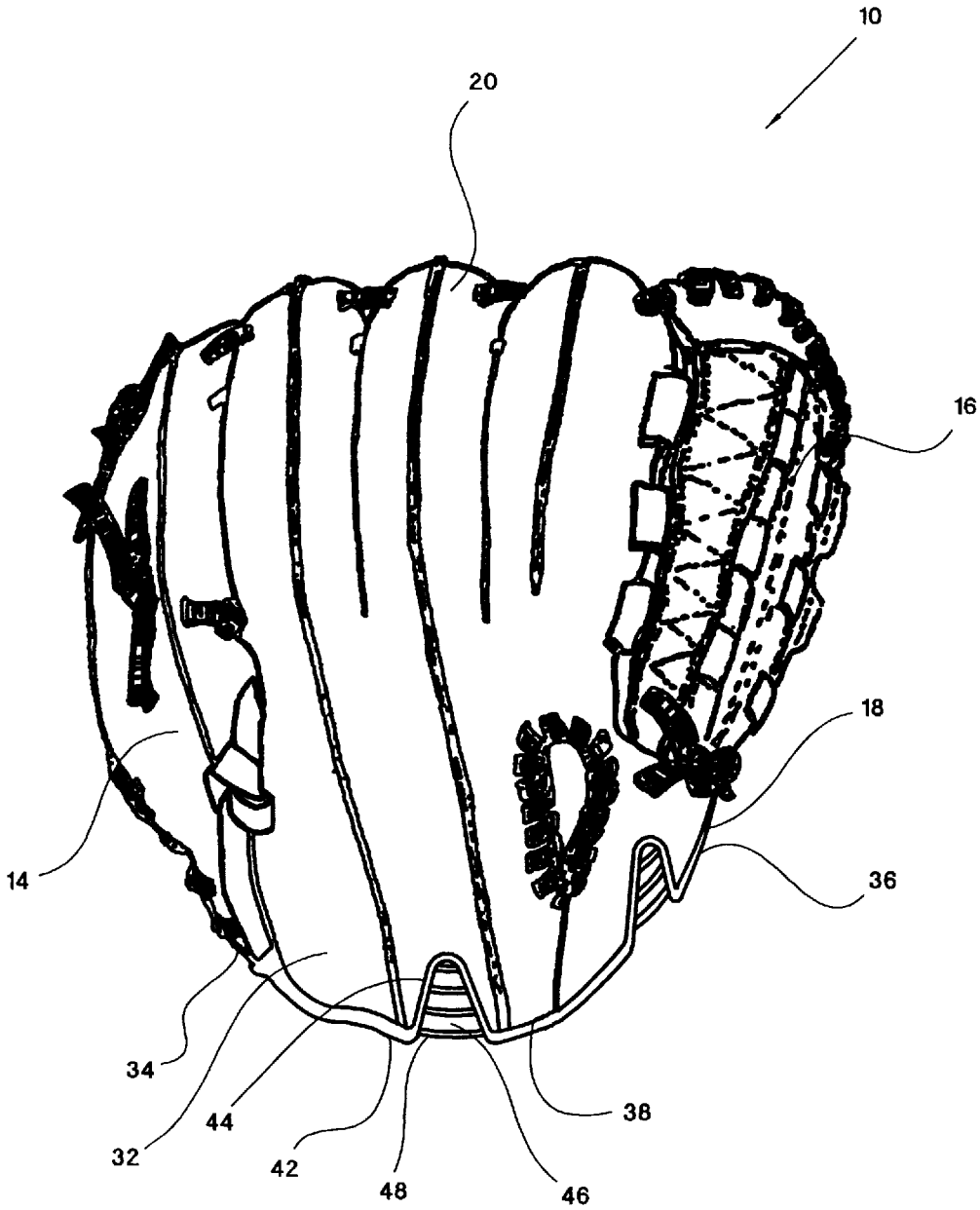
FIG. 1 is a rear view of a ball glove in accordance with a preferred embodiment of the present invention.
Figure 2:
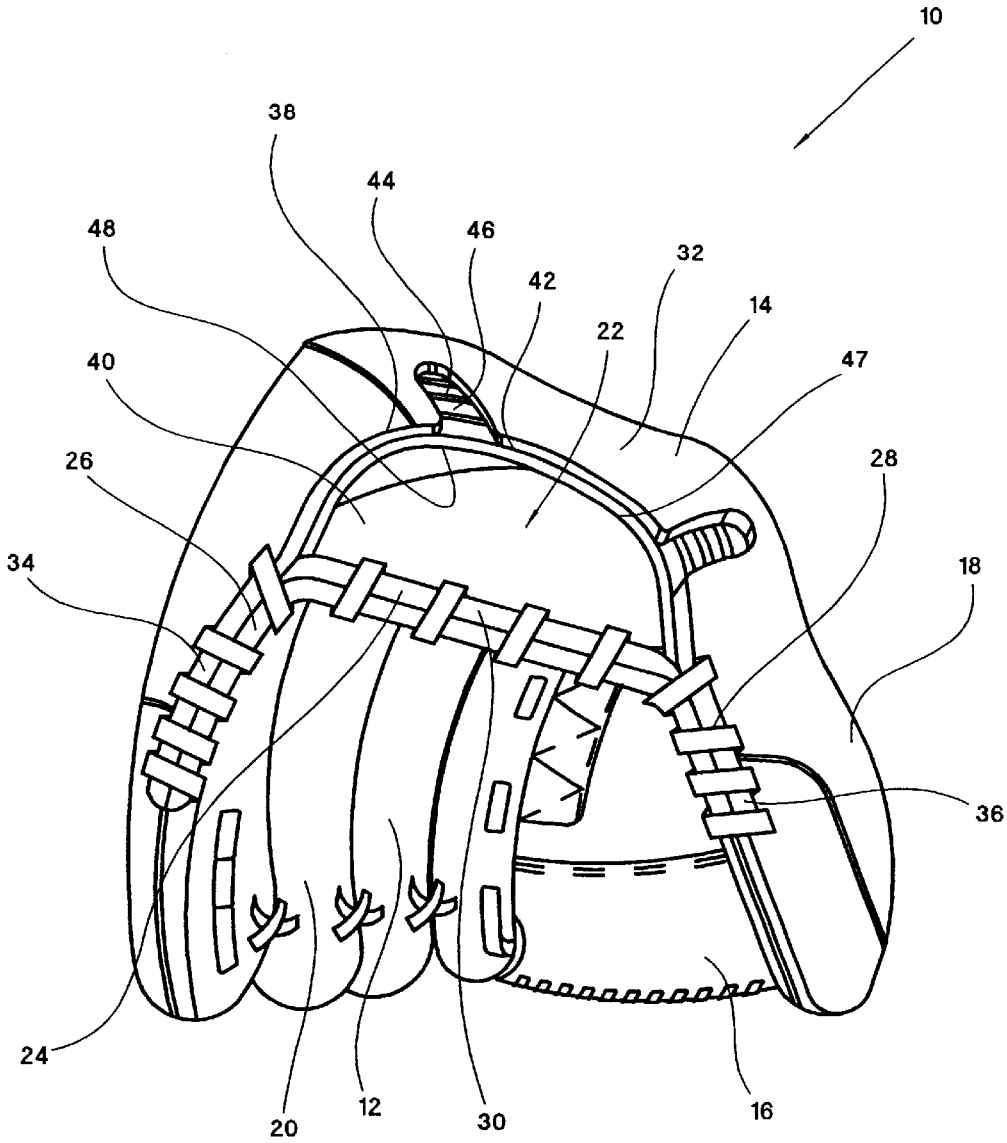
FIG. 2 is a front, bottom view of the ball glove of FIG. 1.
Figure 3:
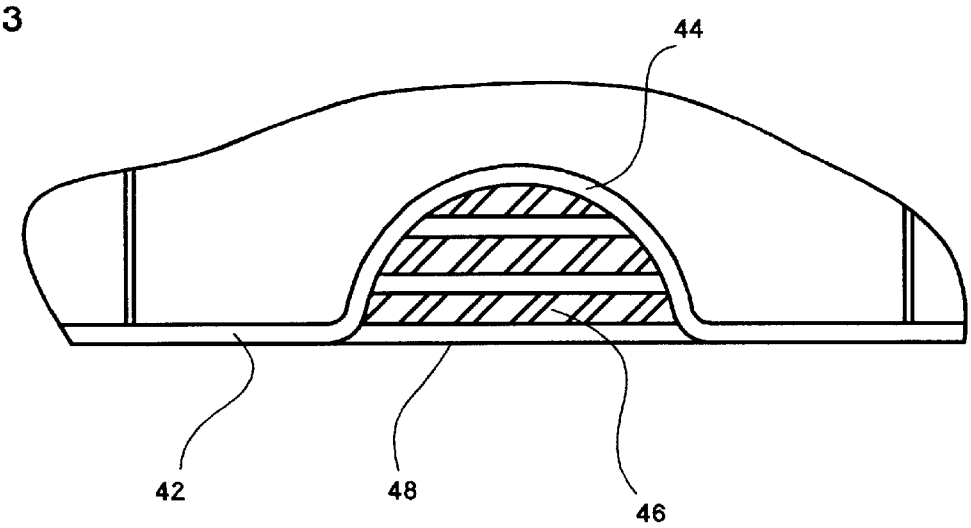
FIGS. 3 through 8 are sectional views of a back portion of a ball glove in accordance with alternative embodiments of the present invention.
Figure 4:
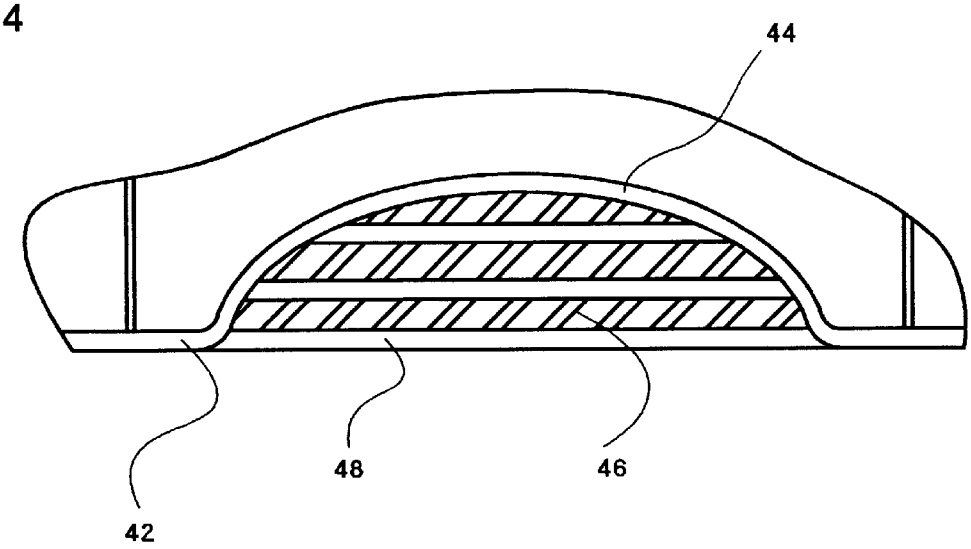
Figure 7:
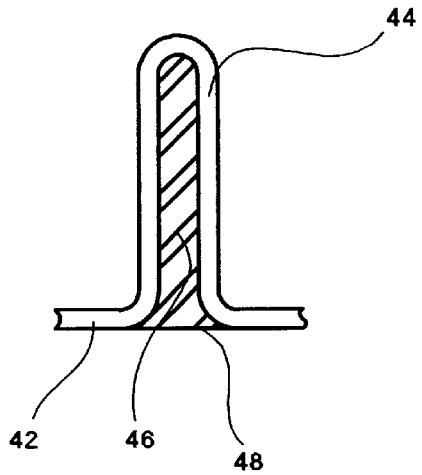

Referring to FIGS. 1 and 2, a ball glove is indicated generally at 10. The ball glove 10 is configured for use in baseball, softball, hockey and other sports involving ball gloves. The ball glove 10 can also be referred to as a mitt. The present invention is directly applicable to any ball glove or ball mitt including, for example, a first baseman mitt and a catcher's mitt. The ball glove 10 includes a front portion 12, a back portion 14 and a webbing 16. The front and back portions 12 and 14 are contoured sheet-like structures, each resembling a hand. The front and back portions 12 and 14 are connected together to form a thumb stall 18 and four finger stalls 20, and to define a hand cavity 22. In an alternative preferred embodiment, the finger stalls 20 can be one or more finger dividers. The front and back portions 12 and 14 are preferably stitched together. Alternatively, the front and back portions 12 and 14 can be connected through other means, such as, for example, bonding or molding. The front portion 12 covers and protects the palm-side of the user's hand from impact with the ball. The back portion 14 supports the front portion 12 and protects the backside of the user's hand. The front and back portions 12 and 14 are made of a pliable, durable, and relatively soft material, preferably leather. In alternative preferred embodiments, the front and back portions 12 and 14 can be made of other materials, such as, for example, artificial leather, rubber and plastic. The webbing 16 is a generally flat structure that is connected, and preferably stitched, to the front and back portions 12 and 14 between the thumb stall 18 and the fingerstall 20 corresponding to the index finger of a user.

The front portion 12 includes a front lower peripheral region 24 having first and second front connection portions 26 and 28 separated by a front hand-receiving portion 30. Similarly, the back portion 14 includes a back lower peripheral region 32 having first and second back connection portions 34 and 36 separated by a back hand-receiving portion 38. The first and second front connection portions 26 and 28 are connected, preferably through stitching, to the first and second back connection portions 34 and 36, respectively. The front and back hand-receiving portions 30 and 38 are spaced apart from each other to define a hand opening 40.

The back lower peripheral region 32 of the back portion 14 includes a lower peripheral edge 42 and preferably two notches 44 upwardly extending into the back lower peripheral region 32 from the lower peripheral edge 42. Each upwardly extending notch 44 preferably includes two opposing sides that curve together to generally form a U-shape. In a preferred embodiment, each notch 44 has a depth of between 0.5 and 2.0 inches and a width of between 0.125 and 2.0 inches. In one particularly preferred embodiment, each notch 44 has a depth of approximately 1.4 inches and a width measured at the lower peripheral edge 42 of approximately 0.6 inches. In alternative preferred embodiments, the notches 44 can be formed in different shapes, or with different lengths and/or widths. Referring to FIGS. 3 through 7, in alternative preferred embodiments, the notch 44 can be formed in other shapes, such as, semi-circular (see FIG. 3), semi-elliptical (see FIG. 4), generally semi-rectangular (see FIG. 5), generally V-shaped (see FIG. 6), elongate (see FIG. 7), polygonal, or irregular.

Referring to FIG. 1, the back portion 14 of the ball glove 10 further includes two panels 46. Each panel 46 is a resilient, flexible sheet. The panel 46 is coupled, and preferably stitched, to the back lower peripheral region 32 at the notch 44, preferably along the inside surface of the back lower peripheral region 32. Alternatively the panel 46 can be coupled to the back lower peripheral region 32 though other means, such as, for example, bonding, stapling, and gluing. The panel 46 is made of a resilient, tough and soft material, preferably a woven elastic fabric. In alternative preferred embodiments, the panel 46 can include a natural rubber, a synthetic rubber, non-woven fabric, an elastomer and combinations thereof. The panel 46 extends across the notch 44 in a manner that is generally parallel to the lower peripheral edge 42 and covers at least a portion of the notch 44. In a preferred embodiment, the panel 46 substantially covers the notch 44 and has an exposed edge 48. Referring to FIG. 2, in a preferred embodiment, the two panels 46 are formed by a single resilient member 47 extending across the inside surface of the back lower peripheral region 32 at the back hand-receiving portion 38 of the back panel 14. The resilient member 47 provides an elastic strip over the entire back side of the hand opening 40 for extending over the back side of the user's hand and/or wrist.

The panels 46 are configured to maintain the hand opening 40 of the ball glove 10 in a generally constant position or size, when in a standby or unused position. The panels 46 also enable the hand opening to readily expand to accommodate the user's hand as it enters the glove, and, then resiliently and automatically reduce in size to generally conform to the size of the user's wrist. The panels are configured to expand and contract again to facilitate removal of the glove 10 from the user's hand. The panels 46 enable the hand opening 40 of the ball glove 10 to readily and resiliently expand and contract to easily and comfortably adapt to the user's hand and wrist without requiring the user to perform any secondary adjusting, securing or fastening activities. Specifically, the use of adjusting straps, buckles, snap-fit connectors or other similar fasteners is not required in order for the user to secure the glove 10 onto his or her hand. The panels 46 bias the hand opening 40 toward the smaller sized standby position, which generally causes the back portion 14 of the glove 10 to gently bear against the wrist or back-side of the users hand thereby significantly reducing or eliminating the risk of the glove 10 becoming mis-positioned, or falling off, during use. As a result, the panels 46 enable users, including younger users, to quickly and easily place the glove 10 on and off their hand without performing secondary adjustment actions and without the assistance of a second person.

The panels 46 and the back panel 14 can be single or multicolored. The panels 46 can be formed with the same single or multi-colored configuration or in a different single or multi-colored configuration than the back panel 14. The panels 46 provide the glove 10 with a pleasing appearance and an improved aesthetic over gloves having conventional fastening mechanisms positioned adjacent to their hand opening.

Figure 12:
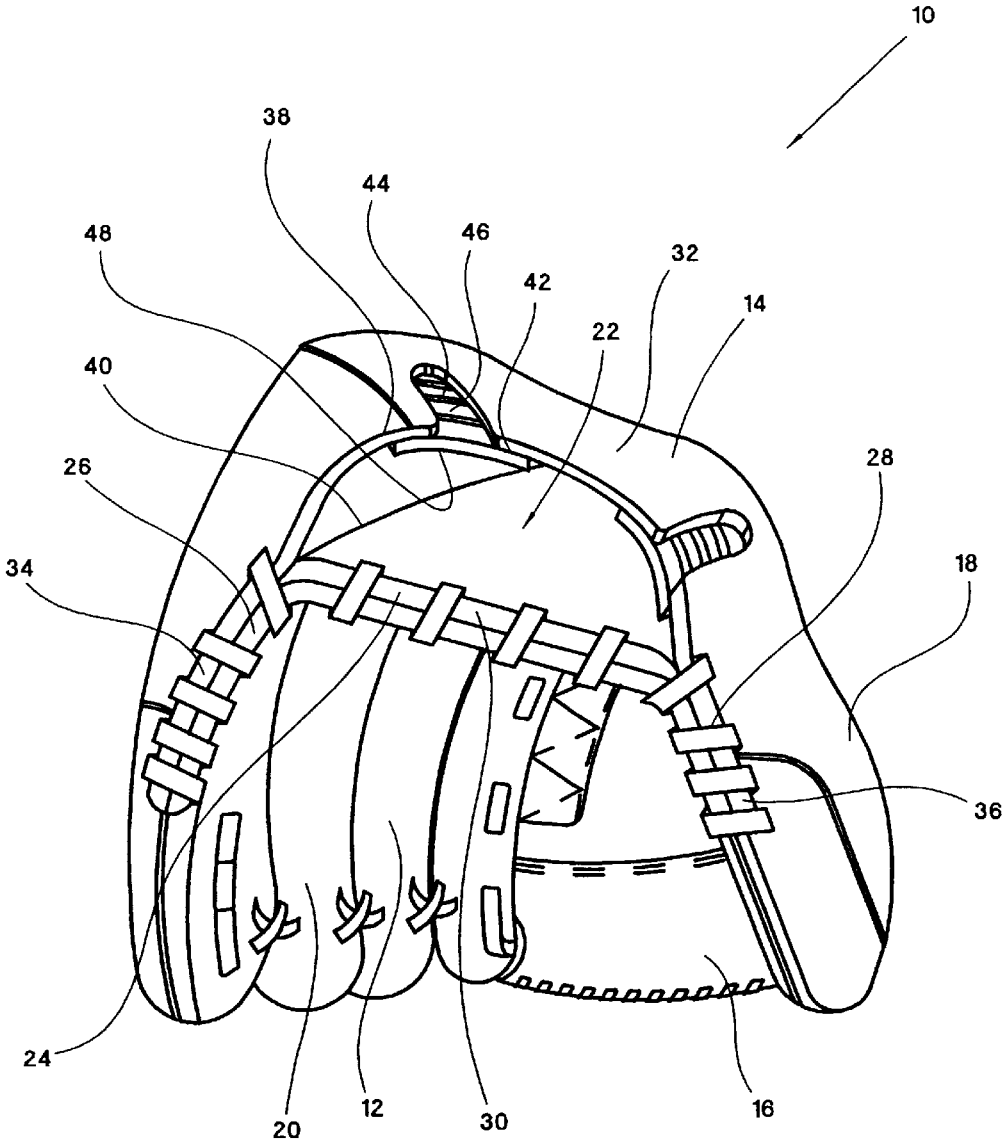
FIG. 12 is a front, bottom view of a ball glove in accordance with another preferred embodiment of the present invention.

Referring to FIG. 12, in an alternative preferred embodiment, each panel 46 is formed by a separate elastic segment that at least partially extends over the notch 44. As a result the elastic segments do not substantially extend across the inside surface of the back lower peripheral region 32 at the back hand-receiving portion 38 of the back panel 14 as shown in FIG. 2. Rather, each panel 46 is sufficiently sized to just cover one of the notches 44. In another alternative preferred embodiment, the panel 46 can substantially fill the notch 44 and lie coincident with the back hand-receiving portion 38.

Figure 8:
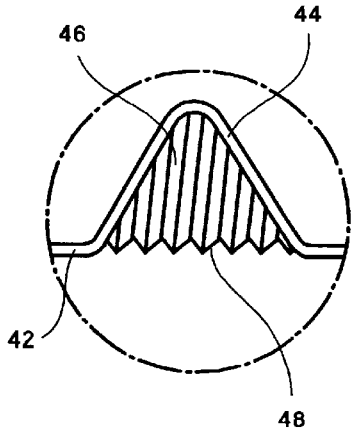
Figure 5:
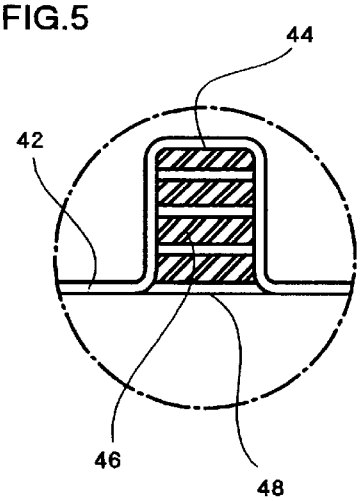
Figure 6:
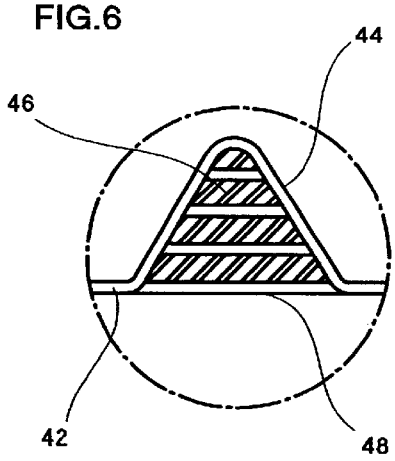
Figure 9:
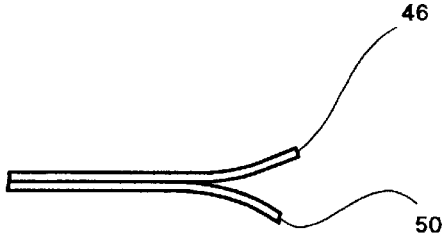
FIG. 9 is a side, partially assembled view of a panel for a ball glove in accordance with another alternative embodiment of the present invention.

Referring to FIG. 8, in another alternative preferred embodiment, the panel 46 can be formed as a pleated or corrugated sheet of material for resiliently expanding and contracting to receive the user's hand. Referring to FIG. 9, in another preferred embodiment, the panel 46 can further include an inner layer 50 formed of a soft, cushionable material, such as padding. The inner layer 50 is connected, preferably by stitching, to the panel 46, and is configured to comfortably contact the hand or wrist of the user.

Figure 10:
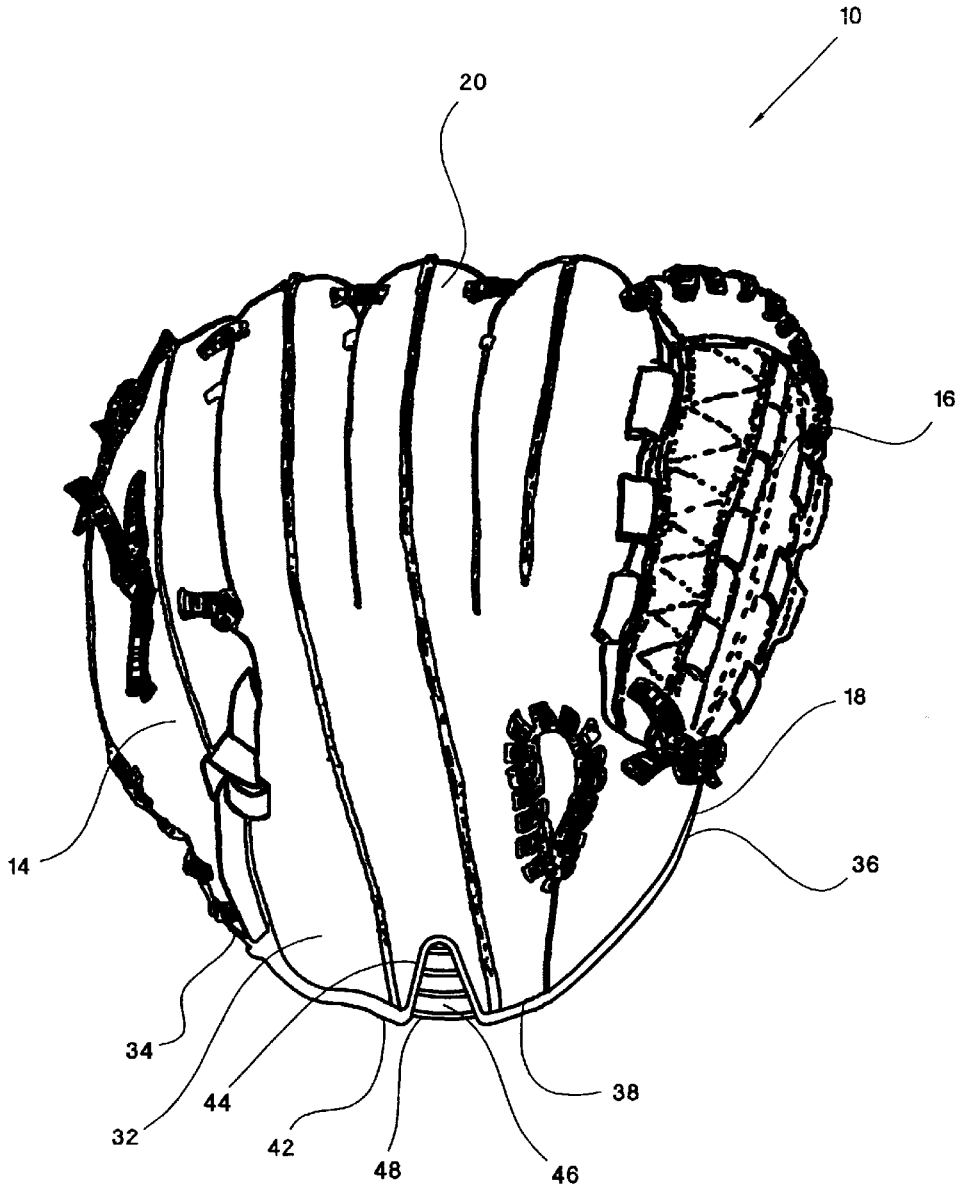
FIG. 10 is rear view of a ball glove in accordance with another alternative preferred embodiments of the present invention.

Referring to FIG. 10, the back panel 14 of the ball glove 10 can be formed with a single notch 44 and a corresponding single panel 46 extending across the recess 44. The notch 44 is preferably generally centrally positioned in the back lower peripheral region 32 of the back panel 14. In alternative preferred embodiments, three or more notches 44 and panels 46 can be incorporated into the ball glove 10.

Figure 11:
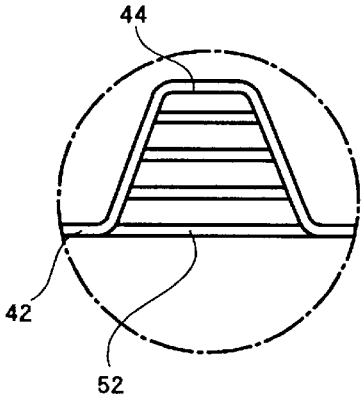
FIG. 11 is a sectional view of a back portion of a ball glove in accordance with alternative embodiments of the present invention.

Referring to FIG. 11, the glove can include at least one elongate strip 52 of elastic material in lieu of the panel 46. Each strip 52 extends across the notch 44 and includes first and second ends, which are fixedly secured to back lower peripheral region 32 on opposite sides of the notch 44. In a particularly preferred embodiment, two or more spaced-apart strips 52 extend across the notch 44. Each strip 52 is made of a resilient, tough and soft material, preferably an elastic fabric. In alternative preferred embodiments, the strips 52 can include a natural rubber, a synthetic rubber, an elastomer and a combination thereof.

While the preferred embodiments of the present invention have been described and illustrated, numerous departures therefrom can be contemplated by persons skilled in the art. Each glove can include two or more panels of varying elasticity. The panels can be interchangeably and releasably connected to the glove at the notch to vary elasticity of the hand opening of the glove. Therefore, the present invention is not limited to the foregoing description but only by the scope and spirit of the appended claims.

What is claimed is:

1. A ball glove for receiving a hand, and generally conforming to the wrist, of a user, the ball glove comprising:

a front portion having a front lower edge;

a back portion coupled to the front portion to form a plurality of finger stalls, a thumb stall, and a hand cavity, the back portion having a back lower edge defining the lowest boundary of the back portion of the ball glove, an inner surface and an outer surface, the front and back portions separated along the front and back lower edges to define a hand opening, the back lower edge having a first length extending along the hand opening, at least one notch formed into the back portion and upwardly extending from the back lower edge into the inner and outer surfaces of the back portion the at least one notch having a total width that is less than 50 percent of the first length;

at least one elastic strip including first and second ends, the strip extending across the notch generally parallel with the back lower edge, the strip at least partially covering the notch, the first and second ends of the strip fixedly secured to the back portion, the at least one elastic strip enabling the hand opening to resiliently expand to receive the hand of the user and then contract to generally conform to the wrist of the user and;

a webbing coupled to, and positioned between, one of the finger stalls and the thumb stall.

2. The ball glove of claim 1 wherein the at least one elastic strip forms one elastic panel configured to substantially cover the notch.

3. The ball glove of claim 1 wherein at least two notches are formed into the back portion of the ball glove.

4. The ball glove of claim 1 wherein the notch is formed in a shape selected from the group consisting of an inverted V-shape, an inverted U-shape, a semi-circular shape, semi-elliptical and a semi-rectangular shape.

5. The ball glove of claim 1 wherein the elastic strip is made of a resilient material selected from the group consisting of a natural rubber, a synthetic rubber, a resilient fabric, an elastomer and a combination thereof.

6. The ball glove of claim 1 wherein the elastic strip and the front and back portions are formed in one or more colors, and wherein the one or more colors of the elastic strip are the same as the one or more colors of the front and back panels.

7. The ball glove of claim 1 wherein the elastic strip and the front and back portions are formed in one or more colors, and wherein the one or more colors of the elastic strip are different than the one or more colors of the front and back panels.

8. The ball glove of claim 2, wherein the panel includes an inner surface, and wherein a layer of padding is attached to the inner surface.

9. A ball glove for receiving a hand, and generally conforming to the wrist, of a user, the ball glove comprising:

a front portion having a front lower peripheral region, the front lower peripheral region having first and second front connection portions spaced apart by a front hand-receiving portion;

a back portion having a back lower peripheral region, the back lower peripheral region having first and second back portions spaced apart by a back hand-receiving portion, the first and second front connection portions connected to the first and second back connection portions, respectively, the front and back hand-receiving portions defining a hand opening for removably receiving the hand of the user, the back hand-receiving portion having a back lower edge of a first length extending along the hand opening, the back lower edge defining the lowest boundary of the back portion of the ball glove, the back hand-receiving portion including at least one upwardly extending notch, the back portion further connected to the front portion to form a plurality of finger stalls and a thumb stall;

at least one elastic panel coupled to the back hand-receiving portion at the notch, the elastic panel substantially covering the notch, and having an exposed lower open edge; the at least one notch having a total width that is less than 50 percent of the first length; and a webbing coupled to, and positioned between, one of the finger stalls and the thumb stall.

10. The ball glove of claim 9 wherein at least two notches are formed into the back hand-receiving portion of the ball glove.

11. The ball glove of claim 9 wherein the notch is formed in a shape selected from the group consisting of an inverted V-shape, an inverted U-shape, a semi-circular shape and a semi-rectangular shape.

12. The ball glove of claim 9 wherein the elastic panel is made of a resilient material selected from the group consisting of a natural rubber, a synthetic rubber, a resilient fabric, an elastomer and a combination thereof.

13. The ball glove of claim 9 wherein the elastic strip and the front and back portions are formed in one or more colors, and wherein the one or more colors of the elastic strip are the same as the one or more colors of the front and back panels.

14. The ball glove of claim 9 wherein the elastic strip and the front and back portions are formed in one or more colors, and wherein the one or more colors of the elastic strip are different than the one or more colors of the front and back panels.

15. The ball glove of claim 9, wherein the panel includes an inner surface, and wherein a layer of padding is attached to the inner surface.

16. The ball glove of claim 9, wherein the panel is fixedly secured to the back hand-receiving portion at the notch.

17. The ball glove of claim 9, wherein the panel is releaseably connected to the back hand-receiving portion of the notch.

18. The ball glove of claim 17, wherein the panel has a first elasticity, and further comprising a second panel having a second elasticity, and wherein the panel and the second panel are interchangeably connected to the back hand-receiving portion.

19. A ball glove for receiving a hand, and generally conforming to the wrist, of a user, the ball glove comprising:

a front portion having a front lower edge;

a back portion coupled to the front portion to form a hand cavity, the back portion having a back lower edge, an inner surface and an outer surface, the back lower edge forming the lowest boundary of the back portion of the ball glove the back lower edge having a first length extending along the hand opening, the front and back portions separated along most of the front and back lower edges to define a hand opening;

at least one notch formed into the back portion and upwardly extending from the back lower edge into the inner and outer surfaces of the back portion the at least one notch having a total width that is less than 50 percent of the first length; and at least one elastic strip including first and second ends, the strip extending across the notch, the strip at least partially covering the notch, the first and second ends of the strip secured to the back portion, the at least one elastic strip enabling the hand opening to resiliently expand to receive the hand of the user and then contract to generally conform to the wrist of the user.

20. The ball glove of claim 19 wherein the at least one elastic strip forms one elastic panel configured to substantially cover the notch.

21. The ball glove of claim 19 wherein at least two notches are formed into the back portion of the ball glove.

22. The ball glove of claim 19 wherein the notch is formed in a shape selected from the group consisting of an inverted V-shape, an inverted U-shape, a semi-circular shape, semi-elliptical and a semi-rectangular shape.

23. The ball glove of claim 19 wherein the elastic strip is made of a resilient material selected from the group consisting of a natural rubber, a synthetic rubber, a resilient fabric, an elastomer and a combination thereof.

24. The ball glove of claim 19, wherein the back portion is coupled to the front portion to form a plurality of finger stalls, a thumb stall, and a hand cavity, and wherein a webbing is coupled to, and positioned between, one of the finger stalls and the thumb stall.

25. The ball glove of claim 20, wherein the panel includes an inner surface, and wherein a layer of padding is attached to the inner surface.

26. The ball glove of claim 20, wherein the panel is fixedly secured to the back portion at the notch.

27. The ball glove of claim 20, wherein the panel is releaseably connected to the back portion of the notch.

* * * * *